United States Patent [19]

Hoo

[11] 4,174,034

[45] Nov. 13, 1979

[54] SAFETY CONTAINER HAVING A SLIDEABLE CLOSURE

[76] Inventor: William K. C. Hoo, 3 Sherwood Dr., Bedford, Mass. 01730

[21] Appl. No.: 923,079

[22] Filed: Jul. 10, 1978

Related U.S. Application Data

[63] Continuation-in-part of Ser. No. 896,735, Apr. 17, 1978, abandoned.

[51] Int. Cl.[2] ..... A45C 13/10; A45C 13/18

[52] U.S. Cl. ..... 206/1.5; 220/347; 220/281

[58] Field of Search ..... 206/1.5, 530, 531, 540; 220/281, 346, 347, 345

[56] References Cited

U.S. PATENT DOCUMENTS

| | | | |
|---|---|---|---|
| 2,708,026 | 5/1955 | Duell | 220/345 |
| 2,881,942 | 4/1959 | Allbright et al. | 220/347 |
| 3,182,856 | 5/1965 | Goltz | 220/345 |
| 3,362,564 | 1/1968 | Mueller | 220/346 |
| 3,888,350 | 6/1975 | Horvath | 220/347 |
| 3,942,630 | 3/1976 | Phillips | 220/346 |
| 3,987,891 | 10/1976 | Horvath | 220/347 |
| 4,076,117 | 2/1978 | Wisdom et al. | 220/347 |

*Primary Examiner*—George T. Hall

*Attorney, Agent, or Firm*—Thompson, Birch, Gauthier & Samuels

[57] ABSTRACT

A two-piece moisture proof safety container for pills and the like has a rectangular drawer and a cover made of a resilient material. The cover and drawer are in the form of mated boxes in which the drawer is slidably engaged within the cover by meshing flanges on the facing surfaces of inside surfaces of sides of the cover and corresponding outside surfaces of the sides of the drawer. This configuration facilitates the automated filling and assembly of the container. The meshing flanges on the drawer and the cover act as cams and cam followers to resiliently urge the drawer, as it is closed, up into tight contact with the underside of the top of the cover by the proper interference fit, effecting a moisture-proof seal. A small catch is attached to the outside of the rear wall of the drawer. This catch engages a portion of the rear wall of the cover, locking the container closed. The rear wall of the cover is provided with a relief slit to allow the cover to be distorted when its sides are squeezed in the appropriate location, so as to release the catch of the drawer from the rear wall of the cover.

22 Claims, 20 Drawing Figures

SAFETY CONTAINER HAVING A SLIDEABLE CLOSURE

BACKGROUND OF THE INVENTION

This application is a continuation-in-part of U.S. Patent application Ser. No. 896,735, filed Apr. 17, 1978; now abandoned.

This invention relates generally to small, compact box-like containers of the type designed to hold pills or the like, and, more particularly to safety containers designed to render their contents substantially unaccessible to small children.

A large number of substances are dispensed in the form of pills, tablets, or capsules intended to be taken in accordance with a prescribed schedule or ad libitum. The container for many such preparations should ideally possess a number of features: it should be compact so as to be easily and conveniently carried in pocket or purse yet not fragile; it should be capable of being easily and securely locked against access to its contents by small children and against accidential spillage, yet be capable of being readily and conveniently opened by its users; it should be designed to seal when closed, thus protecting its contents against the deleterious effects of moisture and the like; and it should be simple and inexpensive to manufacture and fill. Many of the pill and capsule containers presently available have one or more of these features; however, they generally fail to have all of them. Thus, those containers which provide both effective safety locks and moisture proof seals are either difficult to open, too large to be conveniently carried in the pocket, require expensive manufacturing processes, or are difficult to fill or assemble by automatic means. Conversely, those compact containers which are inexpensive and simple to manufacture and to fill either provide unsatisfactory safety locks or inadequate seals. Examples of prior art devices are shown and described in U.S. Pat. Nos. 3,888,350 and 3,987,891.

OBJECTS OF THE INVENTION

Accordingly, it is a general object of the present invention to eliminate or substantially reduce the above-noted disadvantages of prior art containers.

A principal and more specific object of the present invention is to provide an improved compact and rugged safety container for pills and the like, which container can be securely locked closed thereby making access to its contents by small children difficult as well as accidental spillage less likely, yet may be easily opened by an adult when operated in accordance with simple instructions.

Another specific object of the invention is to provide a safety container which automatically seals when closed, protecting its contents from moisture and other atmospheric contaminants.

A further specific object of the invention is to provide a compact sealable safety container which may be easily and inexpensively mass produced and readily filled and assembled.

SUMMARY OF THE INVENTION

These and other objects of the present invention are realized by a shallow two-piece slide cover box which both snap-locks closed and seals upon closure. The box may be squeezed open by simultaneously applying slight pressure to the side walls near its closed end while pulling the two pieces of the box apart. The box is easily molded or otherwise formed from resilient synthetic polymer or other material, and may be filled while disassembled and simply assembled merely by forcing the top portion directly down upon the filled bottom.

The snap-lock and squeeze-open operations are made possible by construction features which include latching means in the form of a hooked tongue and coupling latch, a respective one of each being located on the back wall of the drawer and the rear wall of the cover so as to releasably lock together when the drawer is in a closed position; and meshing flanges in the cover and on the drawer to hold the cover and drawer slidably captive to each other. More specifically, in one embodiment of the invention as one slides the drawer closed along the meshing flanges, the tongue forces the rear wall of the cover to elastically distort or deform until the rear wall overrides the top of the tongue and seats its lower edge in the tongue, locking the container closed. This elastic deformation of the cover is made possible by the clearances between the side walls of the cover and the drawer and by the slot in the rear wall of the cover. A similar deformation may be produced by squeezing together the side walls of the cover of the closed container, in which case the deflection of the side walls causes the rear wall to deform or distort by bowing upward from the back wall of the drawer, disengaging its lower edge from the hooked tongue. The container is therefore unlocked by simultaneously squeezing the side walls of the cover and pulling the drawer forward relative to the cover. All of these operations may be indicated by simple printed instructions on the cover. In an alternative embodiment, rather than as an edge of a wall, the latch is formed as a ridge or lip protruding from a wall surface so as to be engageable by the tongue. It is not critical as to on which of the cover or drawer the tongue and latch are mounted.

The meshing flanges on the drawer and the cover are designed to act as cams and cam followers, respectively. They preferably have profiles which are tapered from front to rear so they not only constrain the drawer to move more-or-less laterally to and fro between closed and opened positions, but also act to force the drawer, as it is closed, up toward, and finally into close contact with the underside of the cover so as to effect a moisture-proof seal. Other design features of the preferred embodiment of the invention which contribute to this seal are the design of the ceiling formed by the underside of the top of the cover to be smooth, flat, and resilient, and provision of a bead, in the form of a knife edge, along the top edge of the walls of the drawer. The components are so dimensioned that the cams and cam followers resiliently urge the bead of the drawer against the ceiling of the cover providing an effective tight seal.

Other objects of the present invention will in part appear obvious and will in part appear hereinafter. The invention accordingly comprises the apparatus possessing the construction, combination of elements, and arrangement of parts which are exemplified in the following detailed disclosure, and the scope of the applications of which will be indicated in the claims.

BRIEF DESCRIPTION OF THE DRAWINGS

For a fuller understanding of the nature and objects of the present invention, reference should be had to the following detailed description taken in connection with the accompanying drawings wherein.

DETAILED DESCRIPTION OF THE DRAWINGS

Figure 1:
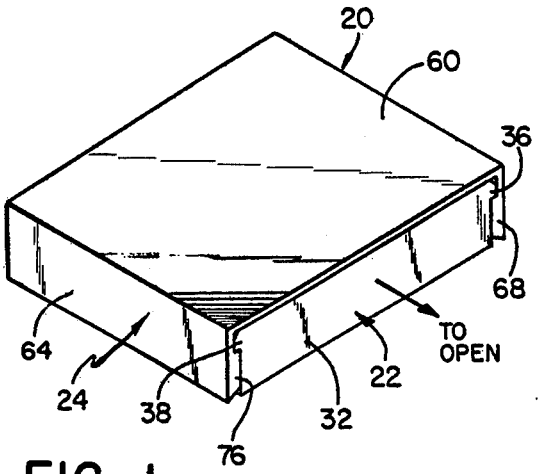
FIG. 1 is a upper front view, in perspective, of the container of the present invention, fully assembled, closed and latched.
Figure 3:
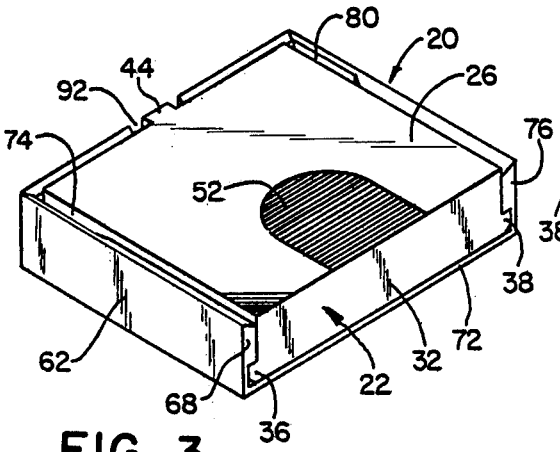
FIG. 3 is a perspective view looking from below at the front of the fully assembled, closed and latched container of FIG. 1.

Referring to FIGS. 1 and 3, there is shown a container 20 formed in accordance with the principles of the present invention, which in a preferred embodiment is relatively small and compact, e.g., typically about 4,732 cms front to rear, 5.847 cms side to side and 1.295 cms top to bottom. Container 20 is preferably entirely formed of polyethylene, polypropylene or any other resiliently distortable synthetic polymeric material well known in the art, which may be molded or otherwise formed into a semirigid shape. It will be understood that other materials may also be used to fabricate containers in accordance with the present invention, provided they are sufficiently impervious to moisture or other contaminants to be sealed out and further provided they are sufficiently resiliently distortable so as to permit the assembly, latching and sealing operations to be described hereinafter. It will further be understood that for different materials, the sizes of various structures to be described hereinafter will be determined by the strenght and flexibility of the material.

Container 20 is formed of a pair of mated or nested portions, drawer 22 (shown in greater detail in FIGS. 4, 7 and 8) and cover 24 (shown in greater detail in FIGS. 5, 6, 9 and 10). As shown particularly in FIG. 4, drawer 22 includes substantially planar, rectangular bottom in the form of thin sheet 26. Connected to one pair of opposite edges of sheet 26 are two side walls 28 and 30. Connected to the other pair of opposite edges of sheet 26 and also to side walls 28 and 30 are front wall 32 and back wall 34. On the outside surfaces of walls 28 and 30 are disposed respective cams in the form of flanges 36 and 38, each protruding a relatively short distance (e.g., 0.117 cms.) outwardly from the corresponding side wall. The lower surfaces (such as surface 40 of flange 36) of the flanges are (1) the working surfaces; (2) lie in planes normal to the respective side wall and (3) are disposed to provide an incline sloping upwardly, for example, between one and two degrees, (i.e. with respect to the plane of bottom sheet 26) from front wall 32 to back wall 34. It will be appreciated that while flanges 36 and 38 are each shown as a single flange extending the entire length between walls 32 and 34, if desired each may comprise two or more sections or each may be formed extending only a portion of the distance between the front and rear walls.

The top edges of walls 28, 30, 32 and 34 all lie in a common plane substantially parallel to the plane of bottom sheet 26, and are preferably each beveled to form knife-edge bead 42 extending completely around the top edges of drawer 22. As shown, particularly in FIGS. 7 and 8, bead 42 is preferably formed along walls 32 and 34 by providing a single beveled surface along the inside surfaces of the walls, while a double bevel is provided on the upper edges of side walls 28 and 30.

Figure 2:
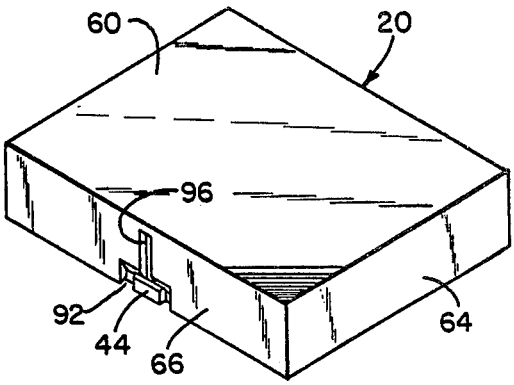
FIG. 2 is a upper rear view, in perspective, of the fully assembled, closed and latched container of FIG. 1.
Figure 4:
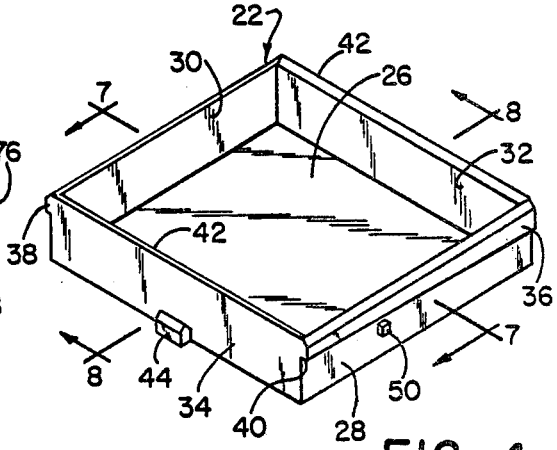
FIG. 4 is an upper rear view, in perspective, of the drawer of the container, similar to the showing of FIG. 2, with the cover removed.
Figure 5:
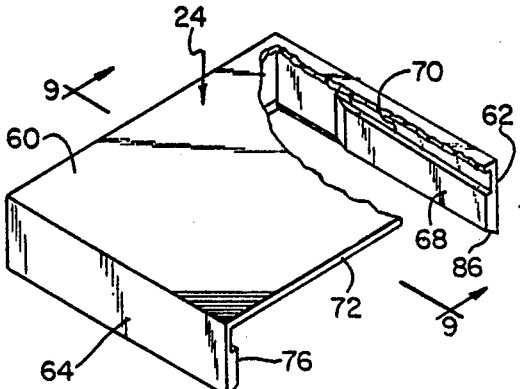
FIG. 5 is an upper front view, in perspective, of the cover of the container, similar to the showing of FIG. 1, with the top partly broken away to show the interior view of one side wall of the cover.
Figure 6:
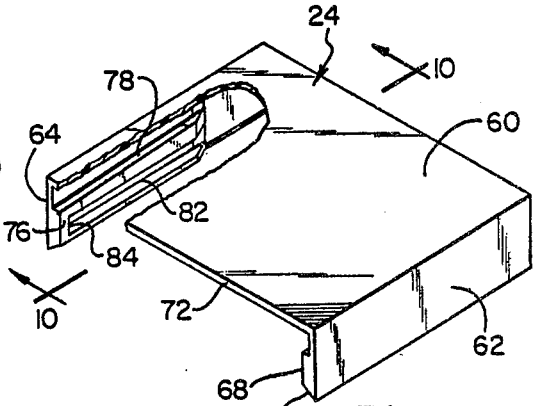
FIG. 6 is another upper front view, in perspective, of the cover of FIG. 5, with the top partly broken away to show the other side wall of the cover.
Figure 8:
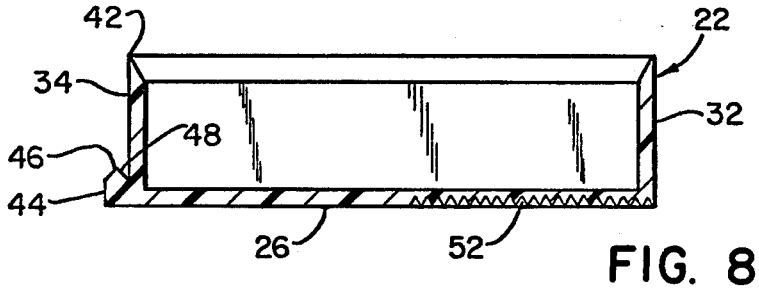
FIG. 8 is a longitudinal-sectional view of the drawer, taken along the line 8—8 in FIG. 4.

Mounted on the outer surface of back wall 34, preferably substantially midway between side walls 28 and 30 and at some predetermined distance from the beveled upper edge of wall 34, is catch 44 in the form of a hooked tongue seen in FIGS. 2 and 4 and in section in FIG. 8. Catch 44 is a preferably integrally formed protrusion from wall 34 and is provided on its upper surface with a double bevel knife-edge 46 extending substantially parallel to the plane of bottom sheet 26 so as to form a groove 48 lying alongside the outer surface of back wall 34.

Figure 7:
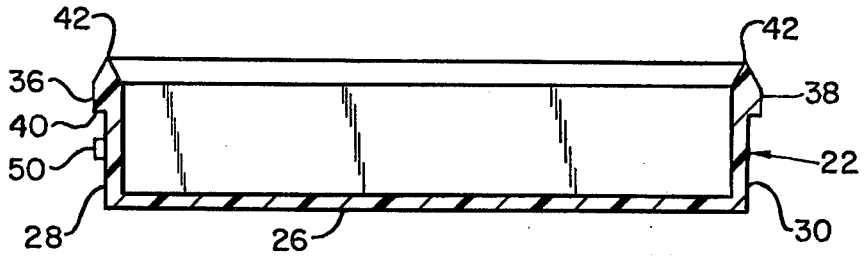
FIG. 7 is a cross-sectional view of the drawer, taken along the line 7—7 in FIG. 4.

As shown in FIGS. 4 and 7, for reasons which will be more evident hereinafter, drawer 22 is also provided with stop post 50 mounted on and projecting a short distance outwardly from side wall 28 at a position intermediate front and back walls 32 and 34 and intermediate the upper and lower edges of side wall 28.

Cover 24 includes a substantially planar, rectangular top in the form of thin sheet 60 having slightly larger rectangular dimensions than bottom sheet 26 of drawer 22. Connected to three edges of sheet 60 are two side walls 62 and 64 and rear wall 66 connected between the side walls, the planes of walls 62, 64 and 66 being normal to the plane of sheet 60. The fourth edge 72 of sheet 60 has no attached wall so that the front of the cover is open. Mounted on the interior surface of side wall 62 is flange 68. The latter is shaped and dimensioned to provide a working surface 70 lying in a plane normal to the plane of wall 62 and inclined from the front of cover 24 toward the rear wall 66 by an angle, preferably between one and two degrees, so that surface 70 slopes toward sheet 60 from the front to the rear of the cover. Flange 68, however, preferably extends from the front of the cover only for part of the distance toward rear wall 66 so as to provide clearance space 74 (as shown in FIG. 3) toward the rear of the container between the corresponding side walls 62 and 30 of cover 24 and drawer 22 when the latter two elements are mated in the closed and sealed position. As will be described later in more detail, flange 68 is intended to serve as a cam follower cooperating with surface 40 of the corresponding flange 38 on drawer 22 to aid in sealing the drawer and cover with respect to one another.

Flange 76, similar to flange 68, is mounted on the interior surface of side wall 64, of cover 24, and is provided with a like inclined working surface 78 designed to serve as a cam follower cooperating with the working surface of flange 36 on drawer 22. The length of flange 76 is preferably limited in the same manner as the length of flange 68 so as to provide (as shown in FIG. 3) a clearance space 80 toward the rear of the container between side walls 64 and 28 of cover 24 and drawer 22, respectively, (opposite the clearance space 74) when cover 24 and drawer 22 are fully mated in a closed and sealed position. Flange 76 also preferably includes a groove or keyway 82 extending partially through flange 76 in a direction approximately parallel to and displaced from working surface 78, the dimensions of keyway 82 being sufficient to slidably accomodate post 50 when drawer 22 is nested in cover 24. One end 84 of keyway 82, adjacent the opening of the cover, is closed to serve as a limit stop to restrict the motion of drawer 22 by engaging post 50. The other end of keyway 82 is open to permit post 50 to be introduced therein. A similar keyway can also be provided in flange 68 to help cooling of the cover during molding thereby increasing the production rate and lowering production cost.

Figure 9:
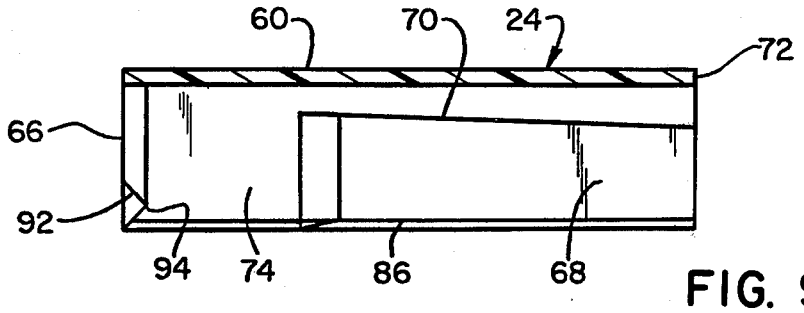
FIG. 9 is a longitudinal-sectional view of the cover taken along the line 9—9 in FIG. 5.
Figure 10:
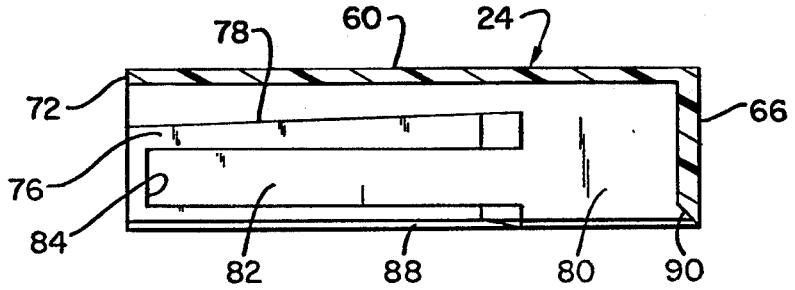
FIG. 10 is a longitudinal-sectional view of the cover taken along the line 10—10 in FIG. 6.

As can be seen in FIGS. 5, 6, 9 and 10, the lower edges 86, 88 and 90 respectively of walls 62, 64 and 66 of the cover are beveled from the outside sloping toward top sheet 60, to permit ready assembly of the container. Rear wall 66, particularly as shown in FIGS. 2, 3 and 9, is provided with a wide slot having an indented lower horizontal edge portion 92 having a beveled knife-edge 94 dimensioned and disposed to ride up over the knife-edge 46 of catch 44 during closure of drawer 22 in cover 24 and to engage with groove 48 when the drawer and cover are in fully closed and sealed position.

For reasons which will become more apparent hereinafter, extending from lower edge portion 92 substantially normal to the plane of the top sheet 60 is a vertical cut or relief slit 96 shown particularly in FIG. 2, through the entire thickness of rear wall 66.

It will be seen that container 20 has been designed to be easily and inexpensively mass produced and simple to fill and assemble. The two parts of the container, drawer 22 and cover 24 have only shallow recesses and undercuts and no complex shapes, and are therefore relatively easy to fabricate. The container has been designed to be filled with a product such as pills while disassembled, and then fully assembled into a closed, locked, sealed condition by the simple preparation of filling drawer 22, placing cover 24 directly above the drawer and then forcing the cover straight down onto drawer 22. The beveled lower side and rear edges 86, 88 and 90 of the cover help center the cover on the drawer during this operation. As the cover is forced down further, the bevels on the lower edges of the walls of the cover, in cooperation with bead 42 on the side walls of the drawer, act to resiliently distort or spring the side walls of the cover outwardly i.e. away from one another. This flexure is made possible by the elasticity of the material from which the cover is made, and by the relief provided by slit 96 in rear wall 66 of the cover. When the cover has been forced down to the point where flanges 68 and 76 override flanges 38 and 36, respectively, the sides of the cover snap back, acting as a pawl, so that the working surfaces 70 and 78 engage the working surfaces of the flanges 36 and 38, respectively, thereby captively assembling the container. The same operation brings the knife-edge 94 of the rear wall of the cover directly down, and into engagement with grooves 48 of catch 44, locking the container in the closed and sealed position. Flanges 38 and 36 and flange followers 68 and 76 are so dimensioned and located that when the container is in the closed condition, bead 42 is resiliently urged into contact with the interior surface of top sheet 60 of cover 24, forming a tight seal by an interference fit. Finally, when the cover and drawer are nested in the closed and sealed position, the post 50 is positioned to the rear of flange 76 aligned so as to enter keyway 82 when the drawer is pulled open, or is positioned in the keyway on assembly.

Figure 11:
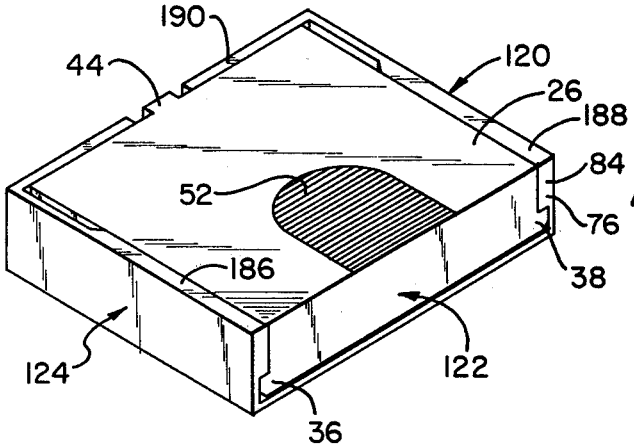
FIG. 11 is a perspective view from below at the front of an alternative embodiment of the present invention, fully assembled, closed and latched.

Referring to FIG. 3, it will be noticed that when container 20 is closed, a slight recess or groove exists along the periphery of the bottom of drawer 22, formed by the beveled lower edges of the side and rear walls of the cover and the side and rear walls of the drawer. In some instances, it may be desirable to eliminate this recess. This would be the case, for instance, if the recess were sufficiently large to permit a small child to gain a purchase on the cover of the closed container with, for example, the child's teeth, thereby being enabled to pry the cover off the drawer, defeating the safety lock feature of the container. Alternative embodiments of the present invention which addresses this problem are shown in FIG. 11 et seq. As will also be described hereinafter, these alternative embodiments incorporate features which permit the container to be assembled by forcing the drawer into the cover through the front open end of the latter, as well as by bringing the cover down upon the drawer.

As shown in FIG. 11, container 120 is formed of a pair of mated portions, drawer 122 (shown in greater detail in FIGS. 12, 13, 14 and 15) and cover 124. Except as hereinafter described, the details of construction, assembly, and operation of container 120 may, for purposes of illustration, be considered to be the same as those previously described for container 20.

The only significant differences between cover 124 and cover 24 are on the lower edges of the side and rear walls of the cover. Referring to FIG. 11, it will be seen that these edges, 186, 188 and 190 are flat, all lying in a common plane substantially parallel to the top of cover 124, and so located as to form, in the assembled, closed container 120 a substantially containuous flat surface with bottom 26 of drawer 122.

Figure 12:
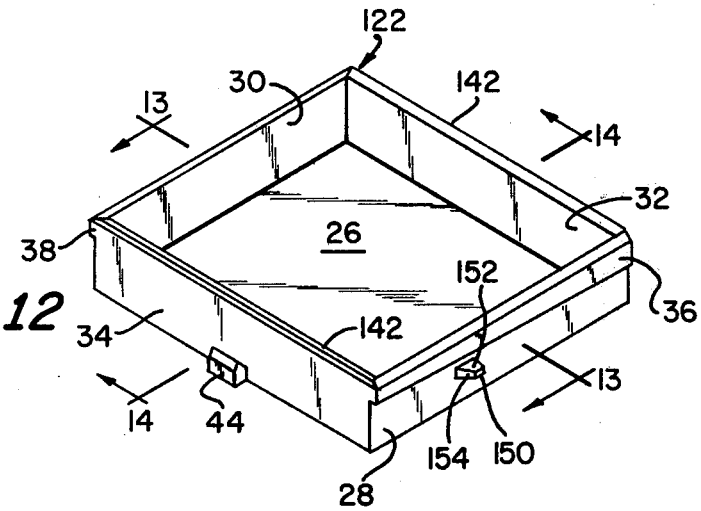
FIG. 12 is an upper rear view, in perspective, of the drawer of the alternative embodiment of the invention.
Figure 13:
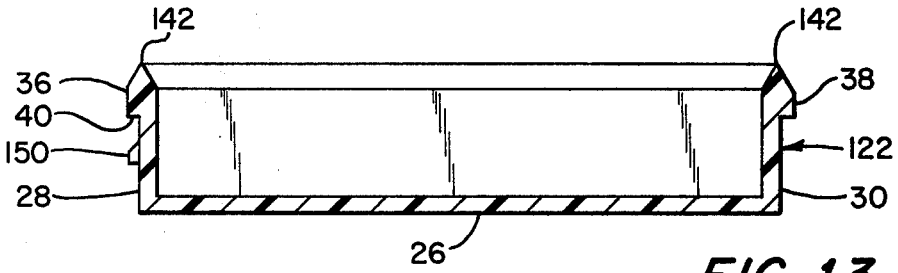
FIG. 13 is a cross-sectional view of the alternative drawer, taken along the line 13—13 in FIG. 12.
Figure 14:
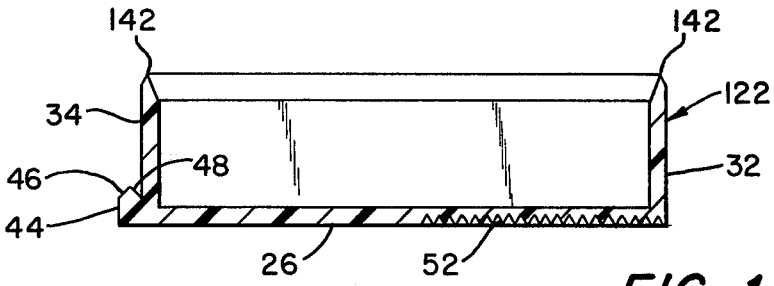
FIG. 14 is a longitudinal-sectional view of the drawer of FIG. 12, taken along the line 14—14.
Figure 15:
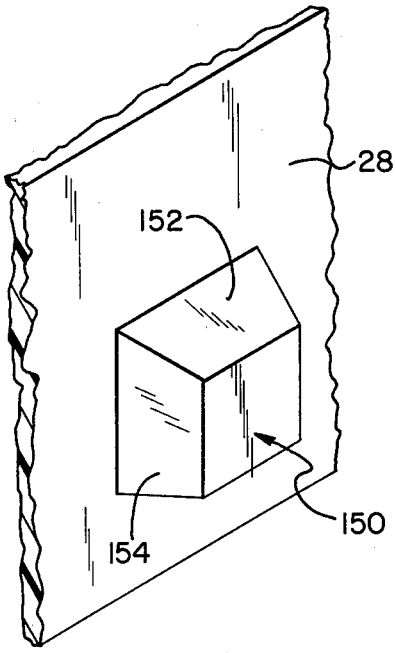
FIG. 15 is an upper rear view, in perspective of a portion of the drawer of FIG. 12, showing the post 150 in detail.
Figure 16:
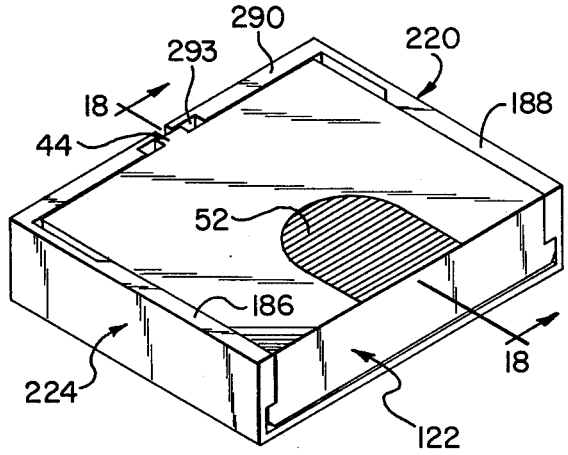
FIG. 16 is a perspective view from below at the front of an additional alternative embodiment of the container, fully assembled, closed and latched.

FIG. 12 shows drawer 122, which is similar to drawer 22. The significant differences are in the structure of bead 142 and stop post 150. As can be seen by reference to FIGS. 13 and 14, knife-edge bead 142 is formed by providing a double bevel on all walls 28, 30, 32 and 34 of drawer 122. The provision of the bevels on the outside of the back wall 34 and the side walls 28 and 30 serves to center cover 124 on drawer 122 when container 120 is assembled as previously described with respect to container 20. The bevels on side walls 28 and 30 act as cams which upon engagement with the side walls during such an assembly operation, resiliently distort the side walls outwardly. In all other respects, bead 142 can be the same in design and function as bead 42.

As seen in FIG. 12, drawer 122 is provided with stop post 150 mounted on and projecting from side wall 28. In the detailed view of FIG. 15, it can be seen that post 150 has top face 152 and rear face 154 in the form of inclined planes forming, in effect, beveled fairings between stop post 150 and side wall 28. Top face 152 lies in a plane normal to the plane of the back wall 34 of drawer 122, making an angle preferably between 30 and 50 degrees with the plane of side wall 28 such that face 152 slopes toward the plane of bottom sheet 26 as face 152 extends outwardly from wall 28. Rear face 154 lies in a plane normal to the plane of bottom sheet 26, making an angle preferably between 30 and 50 degrees with the plane of the side wall 28 such that face 154 slopes away from back wall 34 as face 154 extends outwardly from side wall 28. The slope of top face 152 is to facilitate assembly of container 120 by the method hereinabove described for the assembly of container 20. The slope of rear face 154 is to facilitate front end loading of drawer 122 into cover 124. In all other respects, the construction, function, and operation of stop 150 can be the same as that of stop 50.

Container 120 may be assembled in the manner hereinabove described for the assembly of container 20, the only differences being that since the lower side and rear edges of cover 124 are not beveled, the centering action and the direction of the force to resiliently distort the side walls of the cover outwardly are provided by engagement of bead 142 on the top edges of a wall of drawer 122 with top face 152 of stop 150.

Container 120 may also be assembled by sliding drawer 122 into the open front end of cover 124. As the drawer is closed, stop post 150 engages front end 84 of keyway 82, preventing further closure without the distortion of side wall 64 of the cover. The force to affect this distortion is applied through the wedging action of rear face 154 of stop post 150 against end 84. Again, this flexure is made possible by the elasticity of the material used to make the cover and the relief provided by slit 96 in rear wall 66 of the cover. Once end 84 of keyway 82 has overridden stop post 150, the side of the cover snaps back, capturing post 150 in the keyway. Further closure of the drawer results in both a sealing and locking action as will be described hereinbelow.

Another embodiment of the container of the present invention, shown in FIGS. 16 through 19, has design features which conceal the latching mechanism within the closed container, thereby making its operation less apparent and therefore more tamper-proof. As may be seen in FIG. 16, this container, 220, is formed of drawer 122, described hereinabove, and cover 224.

Figure 17:
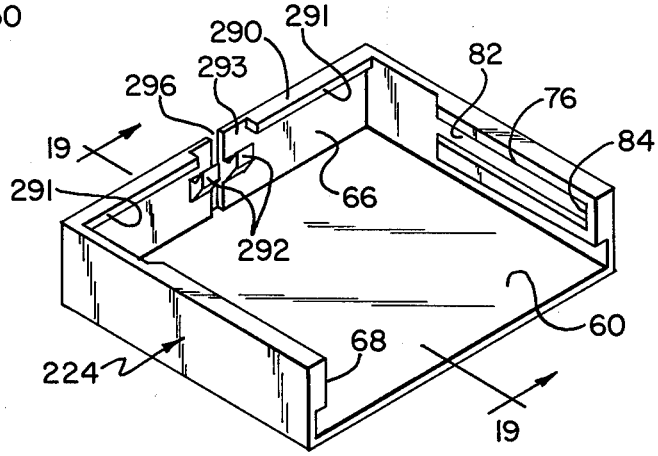
FIG. 17 is a perspective view from below at the front of the cover of the container of FIG. 16.
Figure 18:
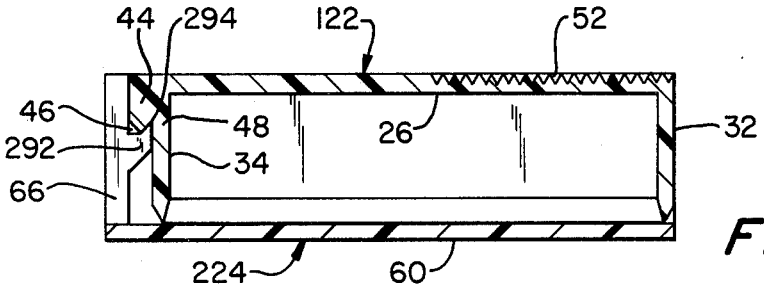
FIG. 18 is a longitudinal-sectional view of the container of FIG. 16, taken along the line 18—18.

Cover 224 differs from cover 124 in a number of details which can be appreciated better by reference to FIG. 17, where it will be seen that latch bolt 292 is formed on the interior of the rear wall 66, on either side of relief slit 296. Slit 296 extends the entire height of wall 66 from top sheet 60 to lower edge 290. In other respects, slit 296 is similar to slit 96. As may be seen by reference to FIGS. 18 and 19, latch bolt 292 is in the form of a hook, having a beveled knife edge 294 dimensioned and positioned to ride up over the knife edge 46 of catch 44 during closure of drawer 122 into cover 294, and to engage with groove 48 when the container is in the fully closed and sealed position. Other than by their placement on the interior of rear wall 66, thereby making their mode of operation less apparent and more tamper proof, bolt 292 and beveled knife edge 294 perform in the same manner as slot 92 and beveled edge 94.

As latch bolt 292 is not a portion of the lower edge of the rear wall 66 as is lot 92, it is obvious that the dimensions of cover 224 must be slightly larger than comparable cover 124, and that back wall 34 of drawer 122 will not be in close contact with the rear wall 66 of cover 224 when the container 220 is in the closed and locked condition. In order to provide closed container 220 with a substantially continuous flat bottom surface, the lower edge 290 of rear wall 66 of the cover 224 is provided with a lip 291, as may be seen in FIGS. 17 and 19. Lip 291 is provided with a central clearance opening 293, shown in FIGS. 16 and 17, dimensioned and positioned about slit 296 so that lip 291 clears catch 44 during the distortion of rear wall 66 in the latching and unlatching operations described hereinbelow.

Figure 20:
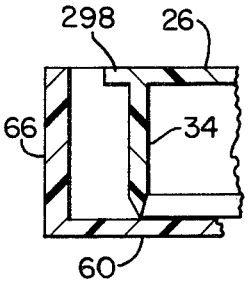
FIG. 20 is a longitudinal sectional view, in fragment, of the rear portions of an alternative form of cover and drawer of the invention.
Figure 19:
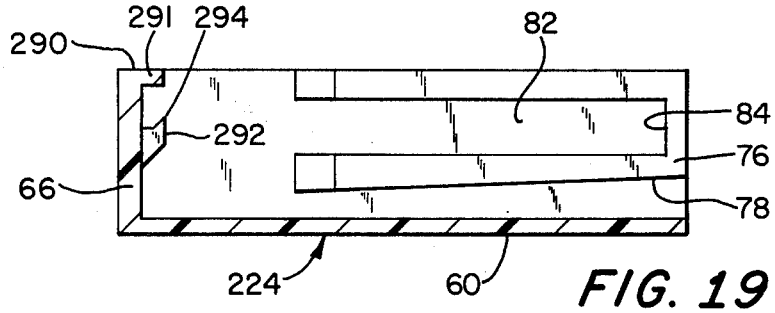
FIG. 19 is a longitudinal-sectional view of the cover of FIG. 17, taken along the line 19—19.

An alternative form of cover and drawer, differing only in the rear portion, is shown in fragment in FIG. 20. The only difference between the forms shown in FIGS. 16–19 and that of FIG. 20 is that lip 291 of FIGS. 16–19 is omitted and replaced by lip 298 which is mounted on back wall 34 of the drawer extending from side wall 28 to side wall 30 (not shown) so as to be coplanar with bottom surface 26. In the closed position, lip 298 abuts rear wall 66 of the cover so as to provide a substantially continuous flat bottom to the container. This small change results in a drastic reduction of molding costs compared to the embodiment of FIGS. 16–19.

Inasmuch as containers 120 and 220 do not differ significantly from container 20 in the details of construction, assembly and operation not hereinabove described, the remaining detailed description will be of container 20, it being understood that like parts of containers 120 and 220 perform similar functions.

The container is designed so that once locked closed, it can only be opened when operated in response to simple instructions, which, for instance, can be given to the user on a printed label attached to the cover. Each container may be opened by squeezing, i.e. simultaneously applying compressive pressure to, for example as shown in FIG. 1, the lower rear edges of the side walls of cover 24, adjacent clearance spaces 74 and 80, while pulling drawer 22 relative to cover 24 open in the directions of the arrow in FIG. 1. Compressive pressure on the lower rear edges of the side walls of the cover will deflect the side walls into clearances 74 and 80 between the cover and the drawer, forcing vertical slit 96 closed and distorting the center of rear wall 66 and the top of the cover so that the rear wall of the cover bows upwardly from the back wall of the drawer and the knife-edge 94 of the rear wall of the cover lifts up and out of groove 48, thereby disengaging edge 94 from groove 48 in catch 44. The drawer flanges 38 and 36 of drawer 22 are then free to slide relative to flanges 68 and 76 of the cover. The dimensions and location of these flanges are such that as the drawer moves forward relative to the cover, the beads 42 of the drawer tend to disengage from the interior surface of top sheet 60 of the cover, breaking the seal. Post 50 rides in keyway 82 until it engages stop 84, limiting the extent of the opening of the drawer relative to the cover.

To reclose the container 20, drawer 22 is forced into cover 24 to automatically lock and seal as follows:

Flanges 38 and 36 of the drawer, sliding on flanges 68 and 76 of the cover cooperate so that the beads 42 of the walls of the drawer move toward top sheet 60 of the cover until the beads 42 contact the inside of top sheet 60. As one slides the drawer closed, beads 42 are resiliently urged against the inside surface of top sheet 60 of the cover providing a tight seal, while simultaneously catch 44 engages and forces lower edge portion 92 of rear wall 66 elastically upward until knife-edge 94 overrides the top of the catch and seats itself in groove 48, locking the container closed. As in the unlatching of the container, the elastic deformation of the rear wall is made possible by the provision of clearances 74 and 80, vertical slit 96, and the elasticity of top, sides and rear wall of the cover. It will be appreciated that beveled knife edge 94, acting cooperatively with the elastic deformations of rear wall 66, functions as a latch bolt, while catch 44 functions as a latch plate.

The present invention thus has various advantages. First, catch 44 and the lower edge portion 92 provide automatic locking of the cover 24 and drawer 22 when the drawer is in the closed position. Drawer 22 can only be moved to the open position by squeezing the rear of the sides of the cover together while simultaneously pulling drawer 22 part of the way through the open front of the cover so as to expose the inside of the drawer. As a consequence the contents stored in the container when the drawer is in the closed position are substantially inaccessible to small children, but readily available to persons adult enough to have the requisite finger span to squeeze the cover appropriately. Flanges 36 and 38 of the drawer and flanges 68 and 76 of the cover interact as cams and cam followers so as to resiliently urge the beads 42 along the upper edges of the drawer against the inside surface of the top sheet 60 of the cover so as to provide an automatic seal when the drawer is in its closed and locked position thereby protecting the contents of the container against exposure to moisture and other contaminants. Finally, the simple design provided by the present invention lends itself to simple mass production of techniques of both manufacture and filling.

It will be understood that the details and specific dimensions of the described embodiment are for the purposes of illustration only, and the invention is not to be construed as limited, except by the scope of the appended claims.

What is claimed is:

1. In a container comprising, in combination:

a cover including a substantially planar rectangular top having coupled to three edges thereof a rear wall and two side walls connected to said rear wall and a fourth edge so as to define with said two side walls an open front end;

a drawer including a substantially planar rectangular bottom of slightly smaller dimensions than said top, said bottom having connected to the four edges thereof a pair of side walls, a front wall connected to said side walls and a back wall connected to said side walls said side, front and back walls of said drawer having respective upper edges lying in a common plane;

said drawer being slidably engagable with said cover so that said drawer is movable between (1) a closed position wherein said drawer fits entirely within said cover and (2) an open position wherein said drawer is displaced from said rear wall of said cover and extends between the side walls of said cover through said open front end of said cover;

latching means for securing said drawer within said cover in said closed position, said latching means comprising a hooked tongue and a latch, each being mounted on a respective one of the exterior surface of said back wall of said drawer and said rear wall of said cover, said latch being constructed and positioned for engaging said hooked tongue when said drawer is in said closed position;

unlatching means for disengaging said hooked tongue and latch from one another, said unlatching means including a slit formed in said rear wall, wherein said cover is made of a distortable material such that compressive pressure applied simultaneously to the two side walls of said cover will distort said rear wall adjacent said slit so as to disengage said latch from said hooked tongue; and sealing means formed of said upper edges of the side, front and back walls of said drawer, and cams and cam followers disposed on the side walls of said drawer and said cover respectively so as to slidably engage one another, said cams and cam followers being dimensioned and positioned so as to resiliently urge said sealing means into tight sealing contact with the interior surface of said top as said drawer is moved toward said closed position.

2. The container according to claim 1, wherein said latching means further includes a slot formed in the lower edge of said rear wall of said cover, said latch being formed by the upper edge of said slot, and said slit extends from said slot toward said top of said cover.

3. The container according to claim 2, wherein said hooked tongue is mounted on the exterior surface of said back wall of said drawer and is dimensioned so as to extend through said slot and said hooked tongue includes a groove formed therein adapted to mate with at least a portion of said upper edge of said slot when said drawer is in said closed position.

4. The container according to claim 3, wherein said upper edge of said slot is a knife-edge.

5. The container according to claim 3, wherein said hooked tongue is substantially centrally located on said back wall of said drawer and said slot and said slit are centrally located in said rear wall of said cover, wherein said slit is dimensioned so as to be narrower than the width of said hooked tongue.

6. The container according to claim 3, wherein said hooked tongue includes a two-sided knife edge so that when said drawer is moved to said closed position, in sequence (1) said upper edge of said slot engages one side of said knife edge, (2) said rear wall distorts, (3) said upper edge of said slot slides over said knife edge and (4) said upper edge of said slot engages the other side of said knife-edge.

7. The container according to claim 1, wherein said latch comprises hook means mounted on the interior surface of said rear wall.

8. The container according to claim 7 wherein said hook means comprises a lip mounted adjacent the lower edge of said rear wall and so dimensioned and positioned as to provide along end edge thereof a substantially continuous suface coplanar with the exterior surface of said bottom of said drawer when said drawer and said cover are in said closed position, and along another edge parallel to said one edge, a beveled portion adapted to engage said hooked tongue.

9. The container according to claim 1, wherein said cam an cam followers include flanges formed on said side walls of said cover and drawer, said flanges including working surfaces each disposed in a plane at a predetermined angle to said side walls and inclined with respect to said top of said cover and said bottom of said drawer.

10. The container according to claim 9, wherein said predetermined angle is approximately 90°.

11. The container according to claim 9, wherein said working surfaces are each disposed in a plane inclined at an angle of about 1 or 2 degrees with respect to said top of said cover and said bottom of said drawer.

12. The container according to claim 9, wherein said sealing means includes a bead formed on said upper edges of said side, front and back walls of said drawer.

13. The container according to claim 9, wherein said flanges formed in said side walls of said cover each extend from said front end of said cover to a position spaced from said rear wall of cover so as to provide a clearance space from said position to said rear wall between opposing side walls of said cover and drawer when said drawer is moved to said closed position, whereing compressive pressure applied simultaneously to said side walls of said cover at said clearance spaces distorts said rear wall of said cover so as to disengage said latch from said tongue.

14. The container according to claim 9 wherein each of said flanges includes a keyway slot.

15. The container according to claim 1 wherein said lower edges of said rear wall of said cover are substantially flat and coplanar, said lower edges being dimensioned and positioned so as to form a substantially continuous surface coplanar with the bottom of said drawer when said drawer is in said closed position.

16. The container according to claim 15 wherein said back wall of said drawer includes a lip projecting therefrom coplanar with said bottom and adapted to abut said rear wall of said cover when in said closed position.

17. The container according to claim 1, further including means for defining said open position so as to limit the extension of said drawer through said open front of said cover when said drawer is in said open position.

18. The container according to claim 9 including means for defining said open position so as to limit the extension of said drawer through the open front end of said cover and including a keyway formed in at least one of said flanges and a stop post mounted on said drawer to slide in said keyway when said drawer is moved between said open and closed positions.

19. The container according to claim 18 wherein said keway has at least one portion engagable with said post for limiting the extension of said drawer through said front end when said drawer is in said open position;

said post having at least one beveled surface disposed so that during initial coupling of said drawer and cover to one another, said beveled surface is engageable by a portion of said keyway so as to serve as a cam for flexibly distorting said cover sufficiently to permit said cover and said drawer to be forced together until said post is captured by said keyway.

20. The container according to claim 19 wherein said beveled surface of said post is a surface facing the top of said cover when said drawer is in said closed position.

21. The container according to claim 19 wherein said beveled surface of said post is a surface facing said front end of said cover when said drawer is in said closed position.

22. The container according to claim 19 wherein said post comprises a frist beveled surface and a second beveled surface, said first and second beveled surfaces respectively facing said front end and stop top of said cover when said drawer is in said closed position.

* * * * *